US008894186B2

(12) United States Patent
Hara et al.

(10) Patent No.: US 8,894,186 B2
(45) Date of Patent: Nov. 25, 2014

(54) LIQUID EJECTING APPARATUS

(71) Applicant: Seiko Epson Corporation, Tokyo (JP)

(72) Inventors: Keiji Hara, Yokohama (JP); Isamu Togashi, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/053,879

(22) Filed: Oct. 15, 2013

(65) Prior Publication Data

US 2014/0267503 A1 Sep. 18, 2014

Related U.S. Application Data

(60) Provisional application No. 61/788,557, filed on Mar. 15, 2013.

(51) Int. Cl.
*B41J 2/05* (2006.01)
*B41J 2/14* (2006.01)

(52) U.S. Cl.
CPC ..... *B41J 2/14* (2013.01)
USPC ..... 347/65

(58) Field of Classification Search
CPC ..... B41J 2/14233; B41J 2002/14419; B41J 2/14145; B41J 2/14024; B41J 2/17513
USPC ..... 347/54, 56, 63, 65
See application file for complete search history.

(56) References Cited

U.S. PATENT DOCUMENTS

| | | | | |
|---|---|---|---|---|
| 6,634,742 | B2 * | 10/2003 | Owaki et al. | 347/93 |
| 8,277,030 | B2 * | 10/2012 | Nagate | 347/68 |
| 8,622,523 | B2 * | 1/2014 | Asai et al. | 347/65 |
| 8,740,354 | B2 * | 6/2014 | Nakao et al. | 347/65 |
| 2001/0030676 | A1 | 10/2001 | Owaki et al. | |

FOREIGN PATENT DOCUMENTS

JP 2002-178541 A 6/2002

* cited by examiner

*Primary Examiner* — An Do
(74) *Attorney, Agent, or Firm* — Harness, Dickey & Pierce, P.L.C.

(57) ABSTRACT

A liquid ejecting apparatus is provided which can suppress bubbles from remaining in liquid flow paths. The liquid ejecting apparatus includes a head that includes a flow path member in which a plurality of ink flow paths are formed, a head main body to which ink is supplied form the flow path member and which ejects the ink to a recording sheet, and a moving element that causes the head to perform a reciprocating moving motion on the recording sheet in the X direction. In the plurality of ink flow paths, the longest ink flow path has the smallest Y direction component on an XY surface (a horizontal surface) of the plurality of ink flow paths.

6 Claims, 9 Drawing Sheets

LIQUID EJECTING APPARATUS

This application claims the benefit of U.S. Provisional Application No. 61/788,557 filed Mar. 15, 2013 which is expressly incorporated by reference herein in its entirety.

TECHNICAL FIELD

The present invention relates to a liquid ejecting apparatus and, in particular, to an ink jet-type recording apparatus which ejects ink as liquid.

RELATED ART

As a typical example of a liquid ejecting apparatus which discharges liquid, there is an ink jet-type recording apparatus which includes an ink jet-type recording head for discharging ink droplets. As the ink jet-type recording head, for example, a recording head which includes a head main body which discharges ink droplets from nozzle openings, and a common flow path member which supplies ink from an ink cartridge (liquid supply element), which is fixed to the head main body and stores ink, to each head main body has been proposed (for example, refer to JP-A-2002-178541).

The flow path member is provided with ink supply needles which are inserted into an ink cartridge and liquid flow paths which communicate with the ink supply needles. If the ink cartridge is mounted on the flow path member, the ink introducing needles are inserted into the ink cartridge, and thus ink in the ink cartridge passes through the insides of the ink introducing needles and is supplied to the liquid flow paths.

In the flow path member according to JP-A-2002-178541, horizontal flow paths are formed along the horizontal direction as the liquid flow paths. In this way, the liquid flow paths are used as the horizontal flow paths, and thus the size of the flow path member in the vertical direction is reduced.

Meanwhile, bubbles may be included in the ink due to various reasons. For example, since the particle diameters of pigment components are relatively large in pigment ink, air in the ink is attached to the pigment components and easily forms into bubbles.

In addition, if the surface tension of ink is small, wettability is improved, and the ink easily flows through the liquid flow paths. As a result, it is difficult that bubbles are generated. Therefore, if the surface tension of ink is large, bubbles are generated easily. For example, when white ink is ejected as a base and CMYK ink is ejected thereon, there is a case in which the surface tension of the white ink is large and the surface tension of the CMYK ink is small. If the surface tension is set in this way, the wetting and spreading of the CMYK ink are excellent and the adhesiveness of the CMYK ink with regard to the base white ink is improved. Meanwhile, the surface tension of ink becomes small as surfactants included in the ink are increased.

In addition, when the ink introducing needles are inserted into the ink cartridge, there is a case in which external air is mixed in the liquid flow paths from the ink introducing needles and bubbles are generated.

If ink in which bubbles are generated because of the above-described reasons is circulated in the horizontal flow paths, there is a problem in that bubbles stay in the horizontal flow paths. That is, the bubbles are attached to and remain in the inside surfaces of the horizontal flow paths. If the bubbles stay in the horizontal flow paths as described above, the horizontal flow paths are closed by the bubbles, and thus there is a concern that it is difficult to supply the ink.

Meanwhile, such a problem exists not only in the ink jet-type recording apparatus but also in a liquid ejecting apparatus which ejects liquid other than ink.

SUMMARY

The present invention has been made by considering the above-described problems, and an object thereof is to provide a liquid ejecting apparatus which can effectively suppress bubbles from remaining in liquid flow paths.

In order to solve the above-described problems, according to an aspect of the invention, there is provided a liquid ejecting apparatus including: a flow path member that includes a plurality of liquid flow paths through which the liquid is circulated; a liquid ejecting head that includes a head main body to which the liquid is supplied from the flow path member and which ejects the liquid to a recording medium; and a moving element that causes the liquid ejecting head to perform a main scan on the recording medium. When it is defined as a first direction a direction in which main scanning is performed, a third direction a direction in which the liquid is ejected, and a second direction a direction which is perpendicular to both the first direction and the third direction, the respective liquid flow paths include horizontal flow paths that are flow paths which are approximately horizontal, and a horizontal flow path which has a longest flow path from among the plurality of horizontal flow paths includes a smallest second direction component from among those of the plurality of horizontal flow paths.

In the aspect, bubbles perform a reciprocating motion along with the reciprocating moving element of the liquid ejecting head. On the other hand, the second direction component of the horizontal flow path which has the longest flow path becomes the smallest. That is, the horizontal flow path is parallel to the first direction or is the closest parallel thereto. Therefore, the reciprocating motion of bubbles along with the reciprocating moving element of the liquid ejecting head is difficult to be closed by the sections of the inside walls of the horizontal flow paths. Since bubbles are difficult to be attached to the inside walls of the horizontal flow paths, the bubbles are easy to be discharged from the horizontal flow paths. Therefore, the liquid ejecting apparatus is provided in which the horizontal flow paths are suppressed from being closed by bubbles and which can excellently discharge liquid.

In addition, it is preferable that, in the plurality of horizontal flow paths, the second direction components be smaller as lengths of the horizontal flow paths are longer. According to this, it is possible to improve discharge properties of bubbles in all of the plurality of horizontal flow paths.

In addition, it is preferable that the horizontal flow paths be formed in such a way that a plurality of linear partial flow paths are continued, and the horizontal flow path which has the longest flow path from among the plurality of horizontal flow paths have a smallest summation of the second direction components for the respective partial flow paths from among the plurality of horizontal flow paths. According to this, it is possible to improve discharge properties of bubbles even when the flow path member which includes the horizontal flow path having the plurality of linear partial flow paths is used.

In addition, it is preferable that the plurality of horizontal flow paths be provided for respective kinds of the liquid. According to this, it is useful for a case in which the easiness of the generation of bubbles differs according to the kinds of liquid.

In addition, it is preferable to further include a liquid supply element that supplies pigment ink as the liquid. According to this, since the discharge properties of bubbles is high even when pigment ink in which bubbles are generated easily compared to dye ink is used, it is possible to suppress the horizontal flow paths from being closed by bubbles.

In addition, it is preferable to further include a liquid supply element that supplies first liquid which includes a relatively large amount of surfactants and second liquid which does not include the surfactant or includes a relatively small amount of surfactants, as the liquid, and, it is preferable that the second liquid be supplied to the horizontal flow path which is the horizontal flow path having the longest flow path from among the plurality of horizontal flow paths and which has the smallest second direction component from among the plurality of horizontal flow paths. According to this, it is possible to further securely suppress the staying and closing action of bubbles in the horizontal flow paths, through which the second liquid in which bubbles are generated easily is circulated.

DETAILED DESCRIPTION

First Embodiment

The invention will be described based on embodiments. An ink jet-type recording head is an example of a liquid ejecting head, and simply called a head. An ink jet-type recording apparatus is an example of a liquid ejecting apparatus.

Figure 1:
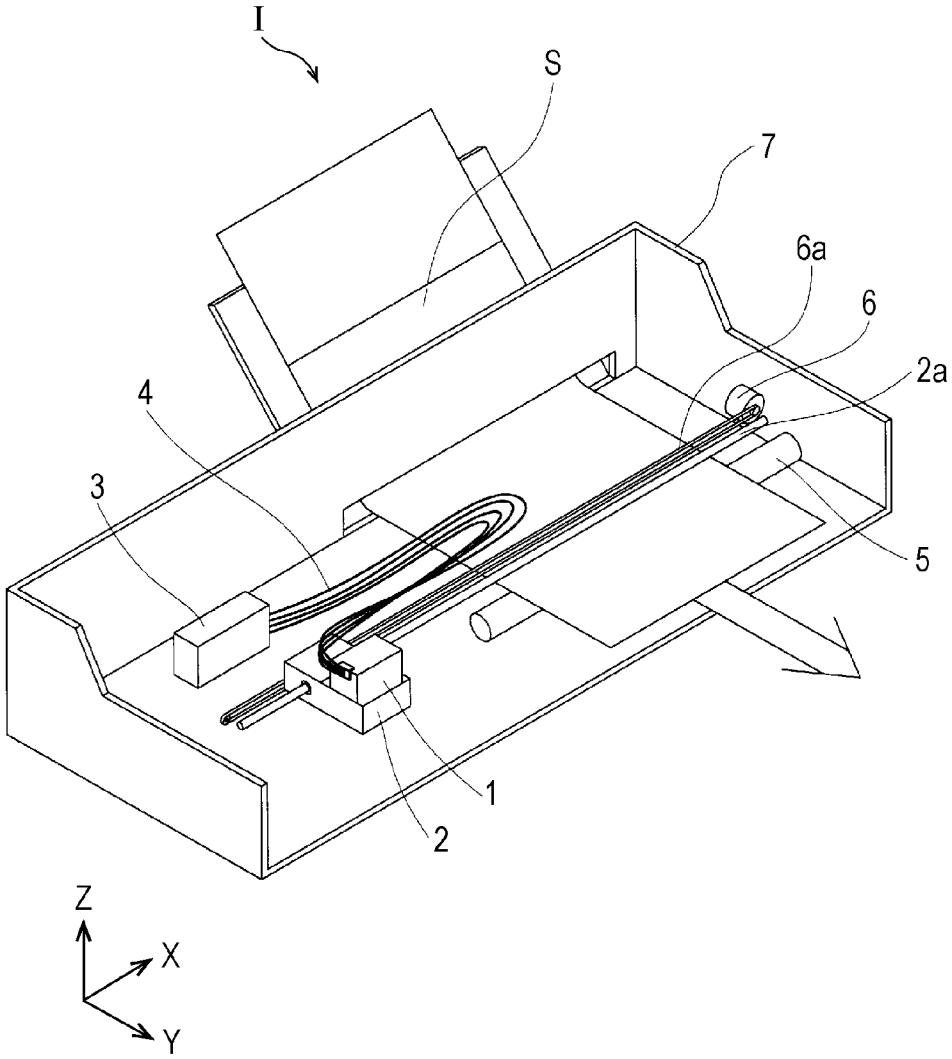
FIG. 1 is a perspective view illustrating an ink jet-type recording apparatus according to a first embodiment.

FIG. 1 is a schematic perspective view illustrating an example of an ink jet-type recording apparatus. An ink jet-type recording apparatus I according to the embodiment includes an apparatus main body 7, and a carriage shaft 2*a* which extends in the X direction (first direction) is provided in the apparatus main body 7. A carriage 2 which can perform a reciprocating moving movement along the X direction is attached to the carriage shaft 2*a*. A head 1 is mounted on the carriage 2.

In addition, in the apparatus main body 7, a storage element 3 which includes a tank for storing ink is provided as a liquid supply element which supplies ink to the head 1. The ink is supplied to the head 1, which is mounted on the carriage 2, from the storage element 3 through a tube 4.

A driving motor 6 and a timing belt 6*a* are provided in the apparatus main body 7. The timing belt 6*a* is attached to the driving motor 6 and the carriage 2, and the driving force of the driving motor 6 is transmitted to the carriage 2 by the timing belt 6*a*. When the driving motor 6 is driven, the carriage 2 performs the reciprocating moving motion along the carriage shaft 2*a* (X direction).

On the other hand, a platen 5 is provided in the apparatus main body 7 along the carriage shaft 2*a*. A recording sheet S, which is a recording medium, such as paper fed by a paper feed roller (not shown in the drawing) or the like, is wound up by the platen 5, and is transported in the Y direction (a second direction which is perpendicular to a first direction on a horizontal surface).

In the ink jet-type recording apparatus I, the carriage 2 is moved along the carriage shaft 2*a* and ink is discharged by the head 1, thereby performing printing on the recording sheet S.

Figure 2:
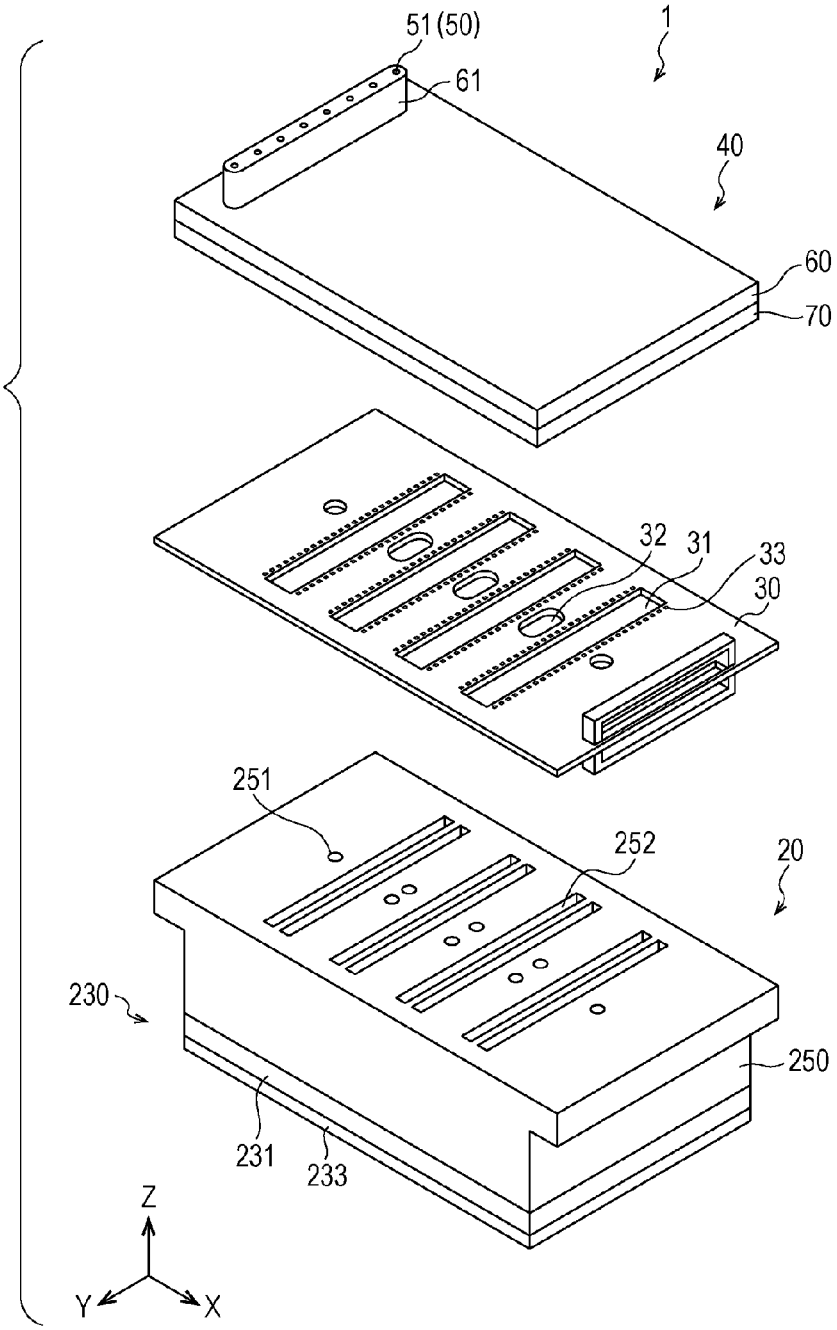
FIG. 2 is an exploded perspective view illustrating a head according to the first embodiment.

FIG. 2 is an exploded perspective view illustrating the head according to the embodiment. The head 1 according to the embodiment includes a head main body 20 which can discharge ink droplets as liquid, a wiring substrate 30 which is held by the head main body 20, and a flow path member 40 which supplies ink to the head main body 20.

Figure 3:
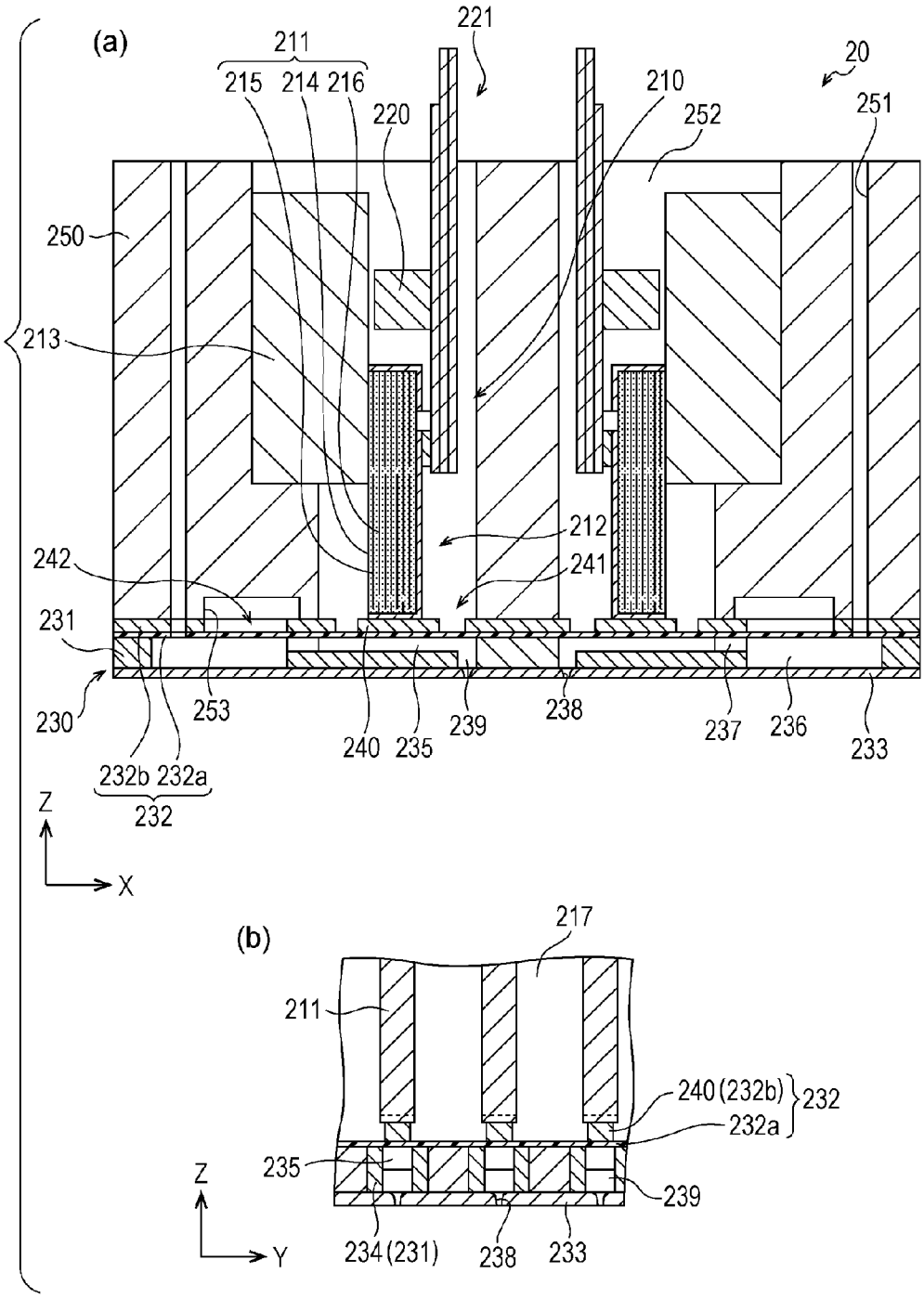
FIG. 3 is a cross-sectional diagram illustrating the main sections of a head main body according to the first embodiment.

First, the head main body 20 will be described in detail with reference to FIG. 3. FIG. 3 is a cross-sectional diagram illustrating the main parts of the head main body.

As shown in FIG. 3, the head main body 20 according to the embodiment includes a plurality of actuator units 210, a casing 250 which can receive the actuator units 210 inside thereof, and a flow path unit 230 which is joined to one surface of the casing 250.

Each of the actuator units 210 according to the embodiment includes a piezoelectric actuator forming member 212, and a fixing plate 213. The piezoelectric actuator forming member 212 is formed in such a way that a plurality of piezoelectric actuators 211 are installed in parallel along the width direction (the Y direction). The piezoelectric actuator forming member 212 includes a base end section (one end section), which is joined to the fixing plate 213 as a fixed end, and an apical end section (the other end section) as a free end.

The piezoelectric actuator forming member 212 is formed by alternately interposing and laminating a voltage material 214, an individual inside electrode 215, and a common inside electrode 216. The individual inside electrode 215 and the common inside electrode 216 are inside electrodes which configure two poles of each of the piezoelectric actuators 211. The individual inside electrode 215 configures an individual electrode which is electrically independent from adjacent piezoelectric actuators 211. The common inside electrode 216 configures a common electrode which is electrically common to the adjacent piezoelectric actuators 211.

A plurality of slits 217 are formed in the piezoelectric actuator forming member 212 using, for example, wire saws or the like. The columns of the piezoelectric actuators 211 is formed by carving up the apical end section side of the piezoelectric actuator forming member 212 in a comb shape by the plurality of slits 217.

An area which is joined to the fixing plate 213 of the piezoelectric actuators 211 is an inactive area which does not contribute to vibration. If a voltage is applied between the individual inside electrode 215 and the common inside electrode 216 which configures each of the piezoelectric actuators 211, the only area on the apical end section side which is not joined to the fixing plate 213 vibrates. Further, the apical end surface of the piezoelectric actuators 211 is fixed to the insular section 240 of a vibration plate 232 using adhesive or the like.

The flow path unit 230 includes a flow path forming substrate 231, a vibration plate 232, and a nozzle plate 233.

The flow path forming substrate 231 is formed of a silicon single-crystal substrate, and a plurality of pressure generation chambers 235 are installed in parallel in the width direction (Y direction). More specifically, the respective pressure generation chambers 235 are partitioned off by a plurality of division walls 234 which are formed in a surface layer section on one surface of the flow path forming substrate 231.

A manifold 236 communicates with each of the pressure generation chambers 235 through ink supply paths 237. In addition, the vibration plate 232 is joined to one surface of the flow path forming substrate 231, and the nozzle plate 233 is joined to the other surface thereof. The vibration plate 232 seals the opening surfaces of the pressure generation chambers 235. The nozzle plate 233 is provided with nozzle openings 238, and is bonded to the flow path forming substrate 231 through an adhesive or a thermal welding film. The flow path forming substrate 231 is provided with communication holes 239 penetrated in the Z direction (the thickness direction of the flow path forming substrate, a direction in which ink is discharged, and a third direction which is perpendicular to the second direction). The nozzle openings 238 of the nozzle plate 233 communicate with the pressure generation chambers 235 through the communication holes 239.

The casing 250 is fixed on the vibration plate 232 of the flow path forming substrate 231. The casing 250 is provided with ink introduction paths 251. The ink introduction paths 251 are connected to the flow path member 40. The ink is supplied to the ink introduction paths 251 from the storage element 3 (refer to FIG. 1) through the flow path member 40 (refer to FIG. 2).

In addition, the casing 250 is provided with a plurality of receiving sections 252 penetrated in the thickness direction, and the actuator units 210 are fixed to the respective receiving sections 252. The head 1 according to the embodiment includes eight actuator units 210, and includes eight receiving sections 252 such that the respective actuator units 210 are independently received.

When ink droplets are discharged, the above-described head main body 20 changes the volumes of the respective pressure generation chambers 235 by modifying the piezoelectric actuators 211 and the vibration plate 232, and discharges ink droplets from the predetermined nozzle openings 238.

More specifically, if ink is supplied to the manifold 236 from the storage element 3 (refer to FIG. 1) through the flow path member 40 and the ink introduction paths 251, the ink is distributed to the respective pressure generation chambers 235 through the ink supply paths 237.

Figure 4:
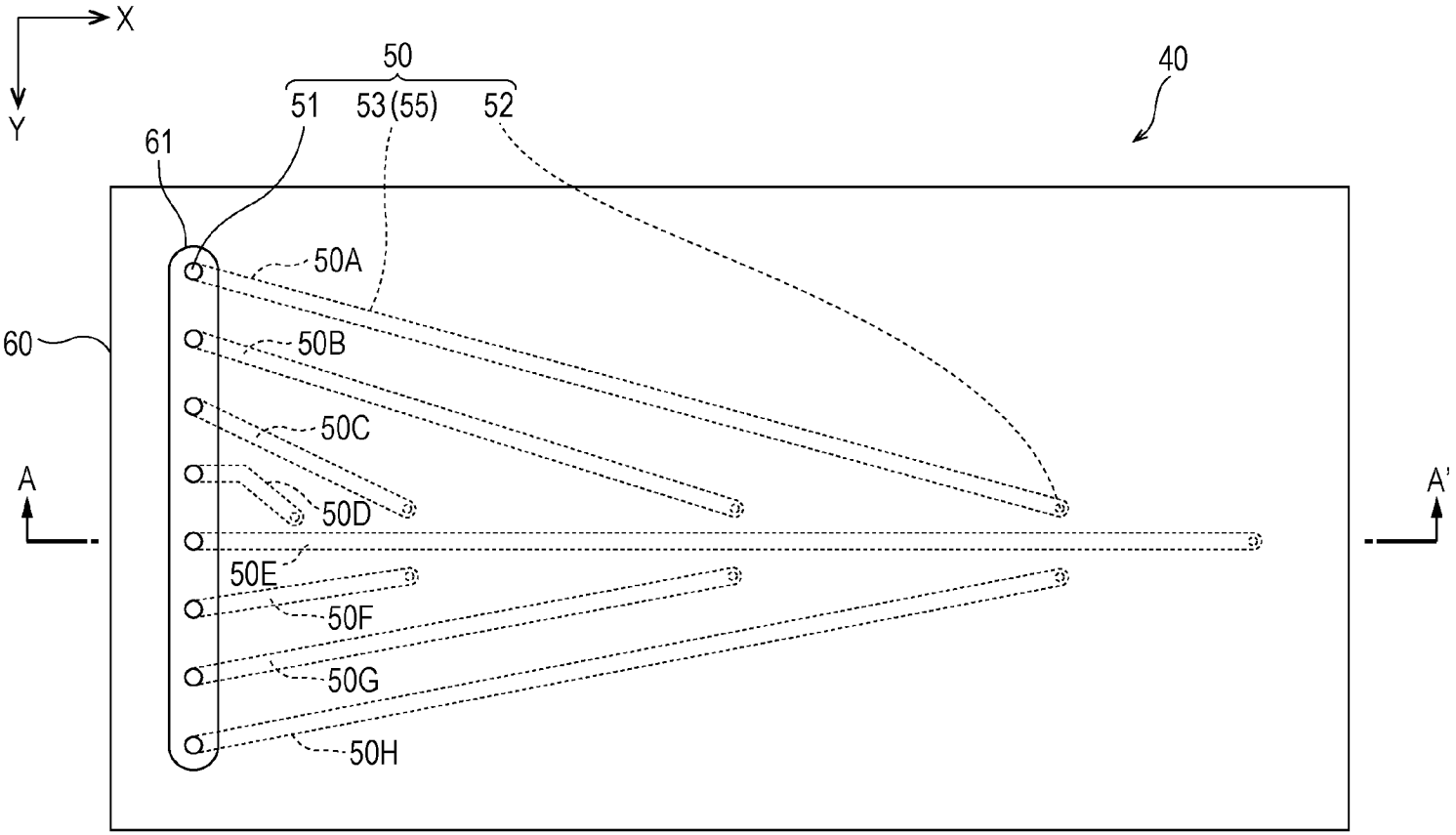
FIG. 4 is a top view illustrating a flow path member according to the first embodiment.
Figure 5:
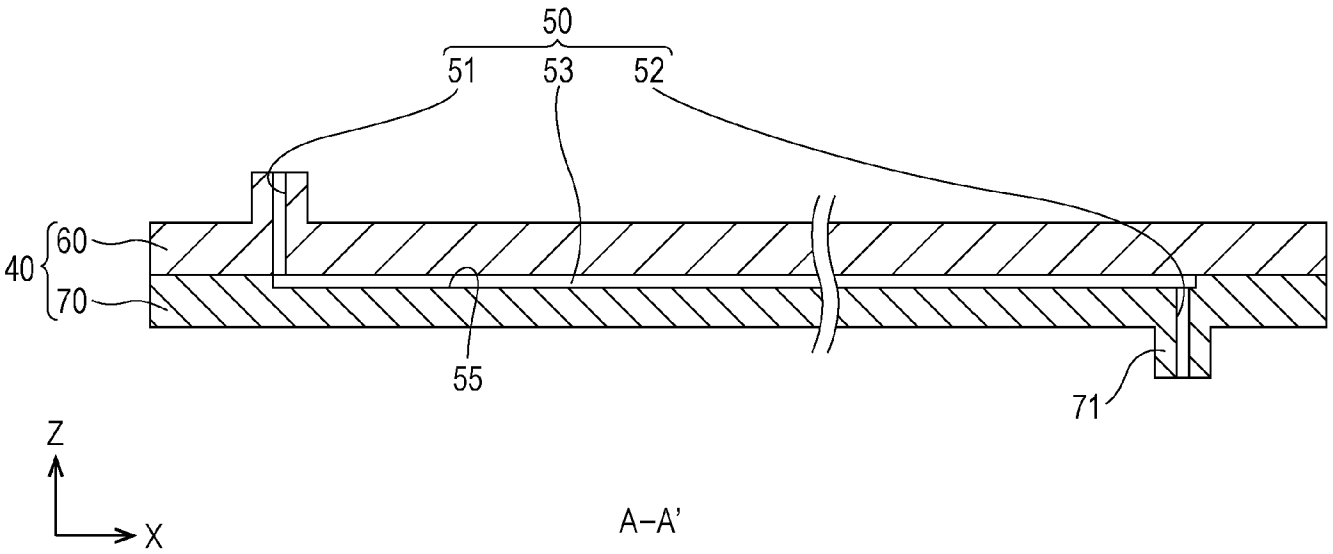
FIG. 5 is a cross-sectional view taken along a line A-A' of FIG. 4.
Figure 6:
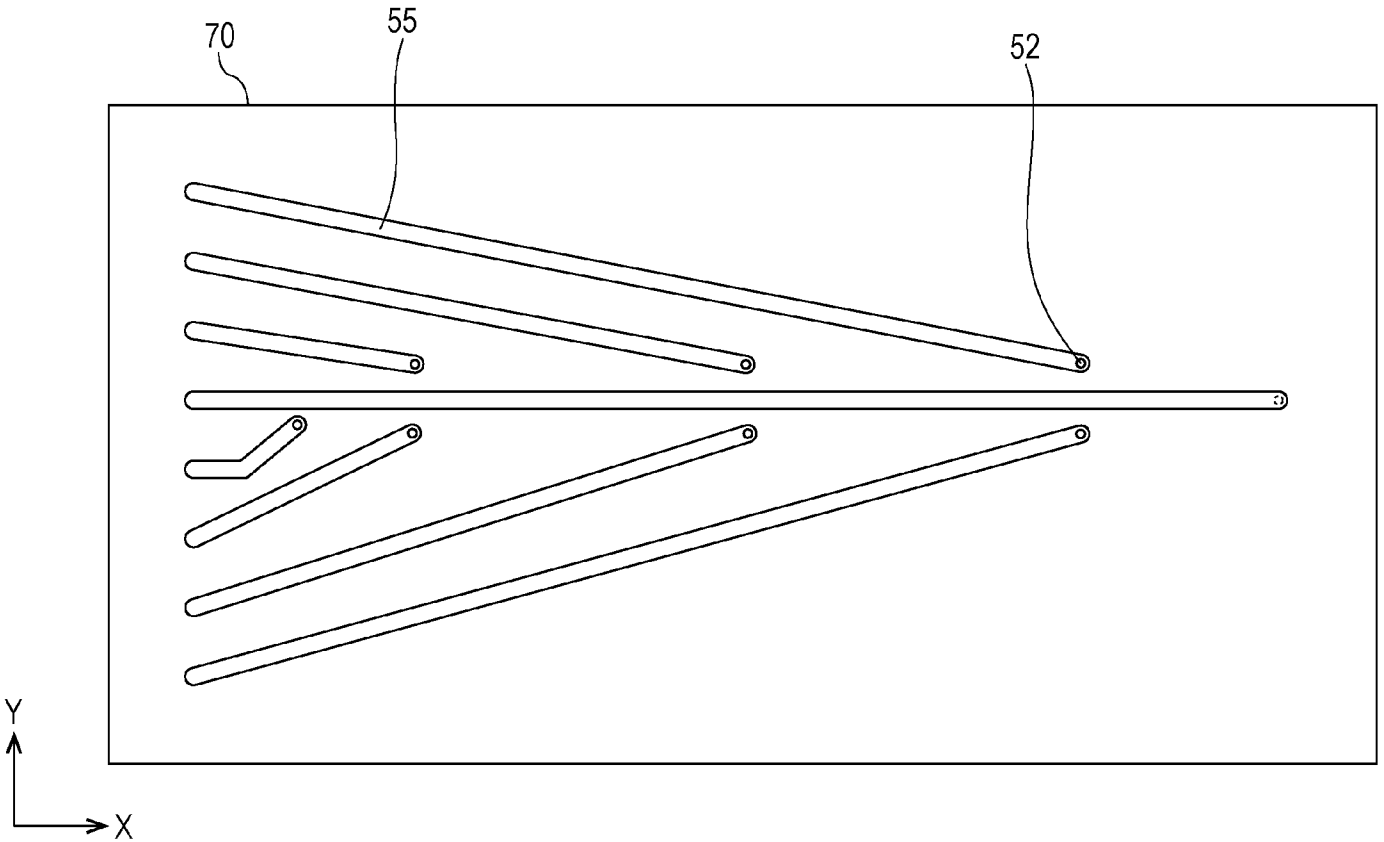
FIG. 6 is a top view illustrating a second member which is included in the flow path member according to the first embodiment.

The flow path member 40 will be described in detail with reference to FIGS. 4 to 6. FIG. 4 is a top view illustrating the flow path member, FIG. 5 is a cross-sectional view taken along a line A-A' of FIG. 4, and FIG. 6 is a top view illustrating the second member which configures the flow path member.

In the flow path member 40, a plurality of ink flow paths 50 (liquid flow paths), through which ink circulates, are formed. According to the embodiment, a first member 60 is joined to a second member 70 in the flow path member 40.

The first member 60 is a member which is formed in a plate shape and the ink flow paths 50 are formed therein. More specifically, in the first member 60, the reception unit 61, which protrudes from the upper surface (a surface which is opposite to the second member 70) of the first member 60 to the upper side, is provided. In addition, in the first member 60, the first flow paths 51 which are through-holes penetrated in the thickness direction are formed.

The first flow paths 51 are open on the top surface of the reception unit 61, and open on the bottom surface (surface on the side of the second member 70) thereof. The ink is supplied to the first flow paths 51, which are open in the reception unit 61, from the storage element 3 (refer to FIG. 1) through the tube 4.

The second member 70 is a member which is formed in a plate shape, and forms the ink flow paths 50. More specifically, eight grooves 55 are formed on the top surface (surface on the side of the first member 60) of the second member 70. In addition, eight connection sections 71 which protrude on the lower side are formed on the bottom surface (surface on the side of the head main body 20) of the second member 70. Further, second flow paths 52, which are through-holes passing through in the thickness direction, are formed in the second member 70.

Each of the second flow paths 52 is open in each of the grooves 55, and is open on the top surface of each of the connection sections 71. In addition, each of the connection sections 71 which is provided in the second member 70 is installed at a position which faces each of the ink introduction paths 251 (refer to FIG. 2). Each of the connection sections 71 is inserted into each of the insertion sections 32 of the wiring substrate 30 and joined to each of the ink introduction paths 251, and thus each of the second flow paths 52 communicates with each of the ink introduction paths 251.

The grooves 55 which are formed in the second member 70 are sealed by the first member 60 which is joined to the second member 70. Spaces, which are made in such a way that the grooves 55 are sealed by the first member 60, become horizontal flow paths 53. The horizontal flow paths 53 according to the embodiment are parallel to a horizontal surface (XY plane). Meanwhile, the horizontality of the horizontal flow paths according to the embodiment includes a range of an angle of approximately −10 to +10 degrees with regard to the XY plane.

Meanwhile, although not particularly shown in the drawing, bosses or adhesives, which protrude on the side of the first member 60 at the marginal parts of the openings of the grooves 55, are provided on the surface of the second member 70. The horizontal flow paths 53 are sealed by the bosses or adhesives.

The ink flow paths 50 are formed in the flow path member 40 in such a way that the first flow paths 51 respectively communicate with the second flow paths 52 at both ends of the horizontal flow paths 53. In the embodiment, eight ink flow paths 50 are formed. Hereinafter, when the individual ink flow paths 50 are mentioned, these are written as ink flow paths 50A to 50H.

As described above, in the ink flow paths 50, ink is supplied to the first flow paths 51 which are open to the reception unit 61 and the ink is supplied from the second flow paths 52 to the ink introduction paths 251. In this way, the flow path member 40 has a function of supplying ink from the storage element 3 to the head main body 20.

In addition, as shown in FIG. 4, when viewed from the top surface, the second flow paths 52 are formed in combination with the positions of the ink introduction paths 251 (refer to FIG. 2) and the horizontal flow pathsanjare formed to supply ink to the second flow paths 52. That is, like the reception unit 61 of the flow path member 40, even a case of a structure in which ink is collected at one spot and then supplied becomes a structure in which the horizontal flow paths 53 introduces ink to the second flow paths 52 formed in combination with the ink introduction paths 251. Therefore, it is possible to configure the head main body 20 regardless of a structure, in which ink is supplied, of the flow path member 40, the storage element 3, or the like.

In addition, since parts of the ink flow paths 50 of the flow path member 40 are used as the horizontal flow paths 53, the size of the thickness direction (Z direction) of the whole flow path member 40 and the head 1 is smaller than that of a head which includes ink flow paths which are configured with vertical flow paths.

Further, in the flow path member 40 according to the embodiment, the ink flow paths 50 are formed so as to satisfy predetermined relationship according to the parallelism for the direction (X direction), in which the head 1 moves, and the lengths of the ink flow paths 50.

Figure 7:
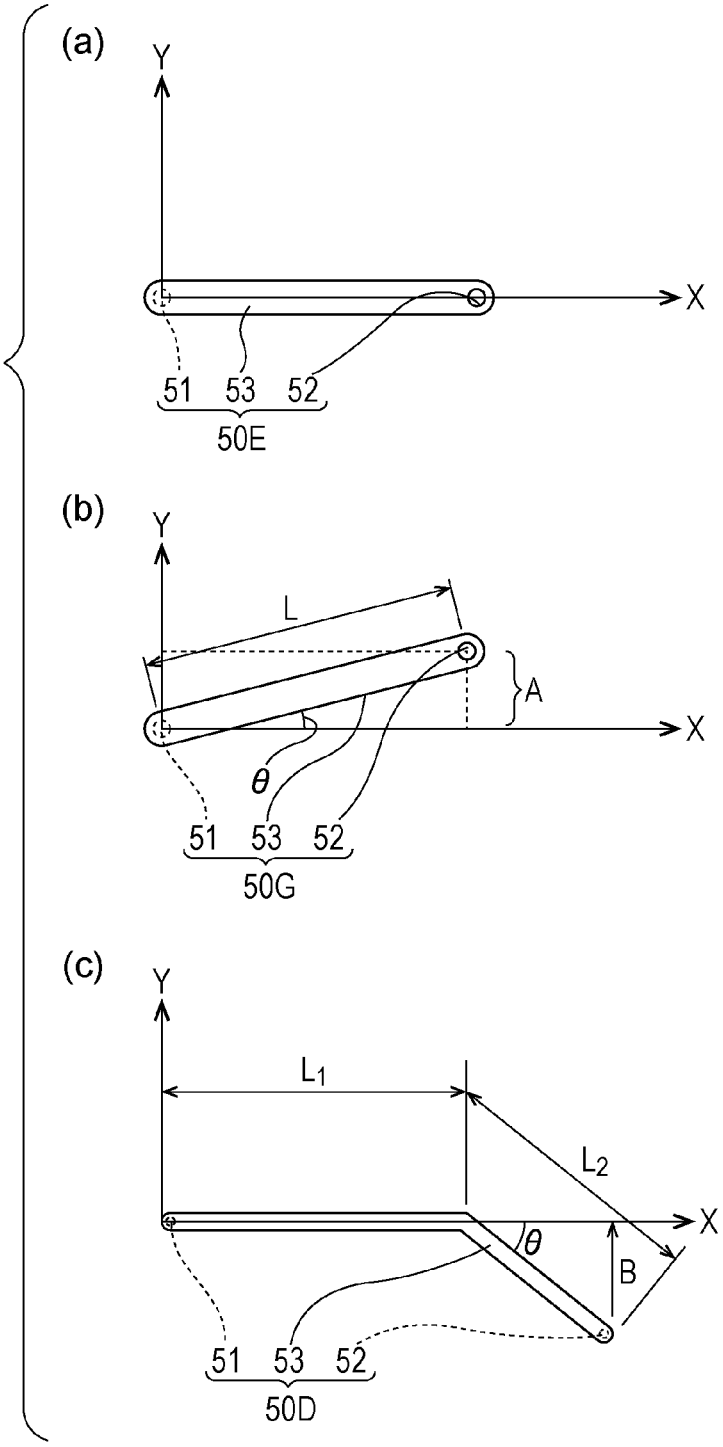
FIG. 7 is a schematic view illustrating the parallelism of ink flow paths according to the first embodiment.

FIG. 7 is a schematic view illustrating the parallelism with regard to the ink flow path 50E, the ink flow path 50G, and the ink flow path 50D.

The parallelism of the ink flow paths 50 mentioned in the embodiment is determined by the sizes of the Y direction (the second direction) components of the horizontal flow paths included in the ink flow paths, and means that, as the parallelism is larger, the Y direction components are smaller and closer to parallel to the X direction. In addition, the lengths of the ink flow paths 50 mentioned in the embodiment are the lengths from the starting points of the horizontal flow paths 53 (parts which communicate with the first flow paths 51) to the ending points (parts which communicate with the second flow paths 52).

As shown in FIG. 7(*a*), the horizontal flow path 53 of the ink flow path 50E is parallel to the X direction. Therefore, the horizontal flow path 53 of the ink flow path 50E has a Y direction component which is zero. That is, the parallelism thereof is the largest.

As shown in FIG. 7(*b*), the horizontal flow path 53 of the ink flow path 50G is linear and has a predetermined angle with respect to the X direction. Therefore, the horizontal flow path 53 of the ink flow path 50G has a Y direction component which is A. If it is assumed that an angle made by the ink flow path 50G and the X direction is θ and the length of the ink flow path 50G is L, A is L sin θ, and the parallelism is determined using the size of A.

As shown in FIG. 7(*c*), the horizontal flow paths 53 of the ink flow path 50D are formed in such a way that two linear partial flow paths are continued. In a case of the ink flow path 50D which is bent, the parallelism thereof is determined by obtaining the Y direction components of the horizontal flow paths 53 for the respective linear partial flow paths and obtaining the summation (absolute value summation) thereof.

In the two partial flow paths of the horizontal flow paths 53 of the ink flow path 50D, the partial flow path on the side of the first flow path 51 which has a length of $L_1$ is parallel to the X direction. Therefore, the Y direction component of this section is zero. On the other hand, the partial flow path on the side of the second flow path 52 which has a length of $L_2$ makes a predetermined angle with the X direction. Therefore, the Y direction component of the partial flow path is B ($L_2$ sin θ). Accordingly, the parallelism of the entire horizontal flow paths 53 of the ink flow path 50D is determined based on the size of B.

Meanwhile, although not particularly shown in the drawing, even when the horizontal flow path of the ink flow path is a curved line shape, it is possible to divide the horizontal flow path into minute partial flow paths. Therefore, the parallelism is determined by obtaining the Y direction components for the respective partial flow paths and obtaining the summation thereof.

Further, in all of the horizontal flow paths 53, the horizontal flow path 53 having the longest flow path has the smallest second direction component in all of the horizontal flow paths 53. That is, the horizontal flow path 53 having the longest flow path has the largest parallelism in all of the horizontal flow paths 53.

In the embodiment, the horizontal flow path 53 of the ink flow paths 50E is the longest. Further, the Y direction component of the horizontal flow path 53 of the ink flow paths 50E is zero, and all of the Y direction components of the horizontal flow paths 53 of the other ink flow paths 50 are greater than zero.

It is possible to suppress bubbles from remaining in the horizontal flow paths 53 by forming the flow path member 40 such that the parallelism of the longest horizontal flow path 53 of the ink flow path 50E becomes maximum as described above.

Figure 8:
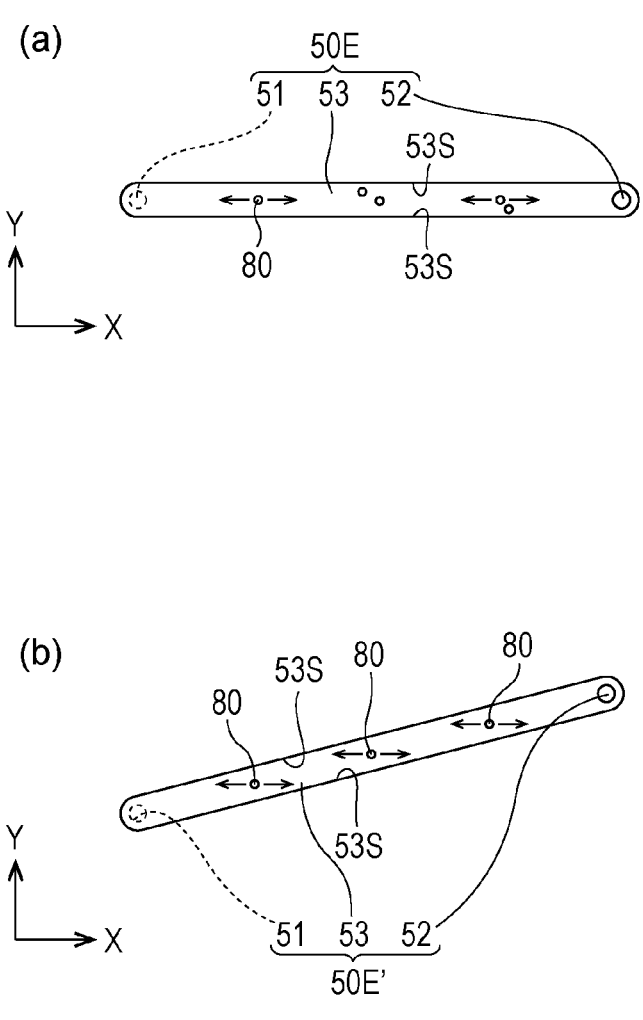
FIG. 8 is a schematic view illustrating the relationship between the ink flow paths and bubbles.

This will be described with reference to FIG. 8. FIG. 8 is a schematic view illustrating the relationship between the ink flow paths 50 and bubbles.

As shown in FIG. 8(*a*), the ink flow path 50E has the Y direction component which is zero, that is, the horizontal flow path 53 is parallel to the X direction. On the other hand, the head 1 performs a reciprocating moving motion in the X direction along the carriage shaft 2*a* (refer to FIG. 1).

Therefore, bubbles 80 which are generated in the horizontal flow path 53 performs the reciprocating motion in the X direction as shown by arrows along with the reciprocating moving element of the head 1. Since the inside walls of the horizontal flow path 53, particularly, the side walls 53S are parallel to the X direction, the reciprocating motion of the bubbles 80 is not closed. That is, as the parallelism of the horizontal flow path 53 is large, the reciprocating motion of the bubbles 80 along with the reciprocating moving element of the head 1 is not closed and become further active.

As described above, as the parallelism of the horizontal flow path 53 is large, bubbles 80 move easily. Therefore, it is possible to discharge the bubbles 80 from the horizontal flow path 53 to the first flow path 51 or the second flow path 52 along with the reciprocating moving element of the head 1. In this way, it is possible to suppress the bubbles 80 from remaining in the horizontal flow path 53. Meanwhile, the bubbles 80, which are discharged to the first flow path 51 or the second flow path 52, are temporarily trapped in, for example, the filters or the like of the ink flow paths 50, collected when the head 1 is cleaned, and discharged to the outside of the head 1.

Here, the longer the horizontal flow path 53 is, the easier the bubbles 80 stay. However, the longest horizontal flow path 53 of the ink flow path 50E is made to have the largest parallelism. Therefore, it is possible to configure the longest horizontal flow path 53 in which the bubbles 80 are the easiest to remain such that the bubbles 80 are easily discharged along with the reciprocating motion of the head 1.

Meanwhile, FIG. 8(*b*) shows a case in which the Y direction component of the longest ink flow path 50E' (horizontal flow path 53) is supposedly the smallest in all of the ink flow paths 50 but is not zero. That is, the horizontal flow path 53 of the ink flow path 50E' is at a predetermined angle with respect to the X direction.

The bubbles 80 perform the reciprocating motion in the X direction along with the reciprocating moving element of the head 1 along the X direction. When the Y direction component of the horizontal flow path 53 is not zero, the side wall 53S of the horizontal flow path 53 is at a predetermined angle with respect to the X direction, and thus the reciprocating motion of the bubbles 80 is slightly closed by the side wall 53S.

However, since the horizontal flow path 53 has the smallest Y direction component in all of the horizontal flow paths 53, that is, the horizontal flow path 53 is the closest parallel to the X direction, the influence of the side wall 53S is minimum. As described above, although the horizontal flow path 53 of the longest ink flow path 50E' is not completely parallel to the X direction, the parallelism thereof is the largest. Therefore, it is possible to configure the longest horizontal flow path 53 in which the bubbles 80 are the easiest to stay such that the bubbles 80 are easily discharged along with the reciprocating motion of the head 1.

As described above, in the ink jet-type recording apparatus I according to the embodiment, the flow path member 40 is formed such that the parallelism of the horizontal flow path 53 of the longest ink flow path 50E is the largest (second direction component is the smallest), and thus it is possible to effectively suppress bubbles from remaining in the horizontal flow path 53.

Therefore, it is possible to suppress the ink flow path 50E from being closed by bubbles, and ink is further securely supplied to the head main body 20, thereby supplying the ink jet-type recording apparatus I in which reliability is improved.

Second Embodiment

Although the flow path member 40 is configured such that the parallelism of the longest ink flow path 50E is the largest in the first embodiment, the invention is not limited to the embodiment.

For example, the flow path member 40 may be configured such that the longer the lengths of the horizontal flow paths 53 of all the ink flow paths 50, the larger the parallelism, that is, the Y direction components become small.

Figure 9:
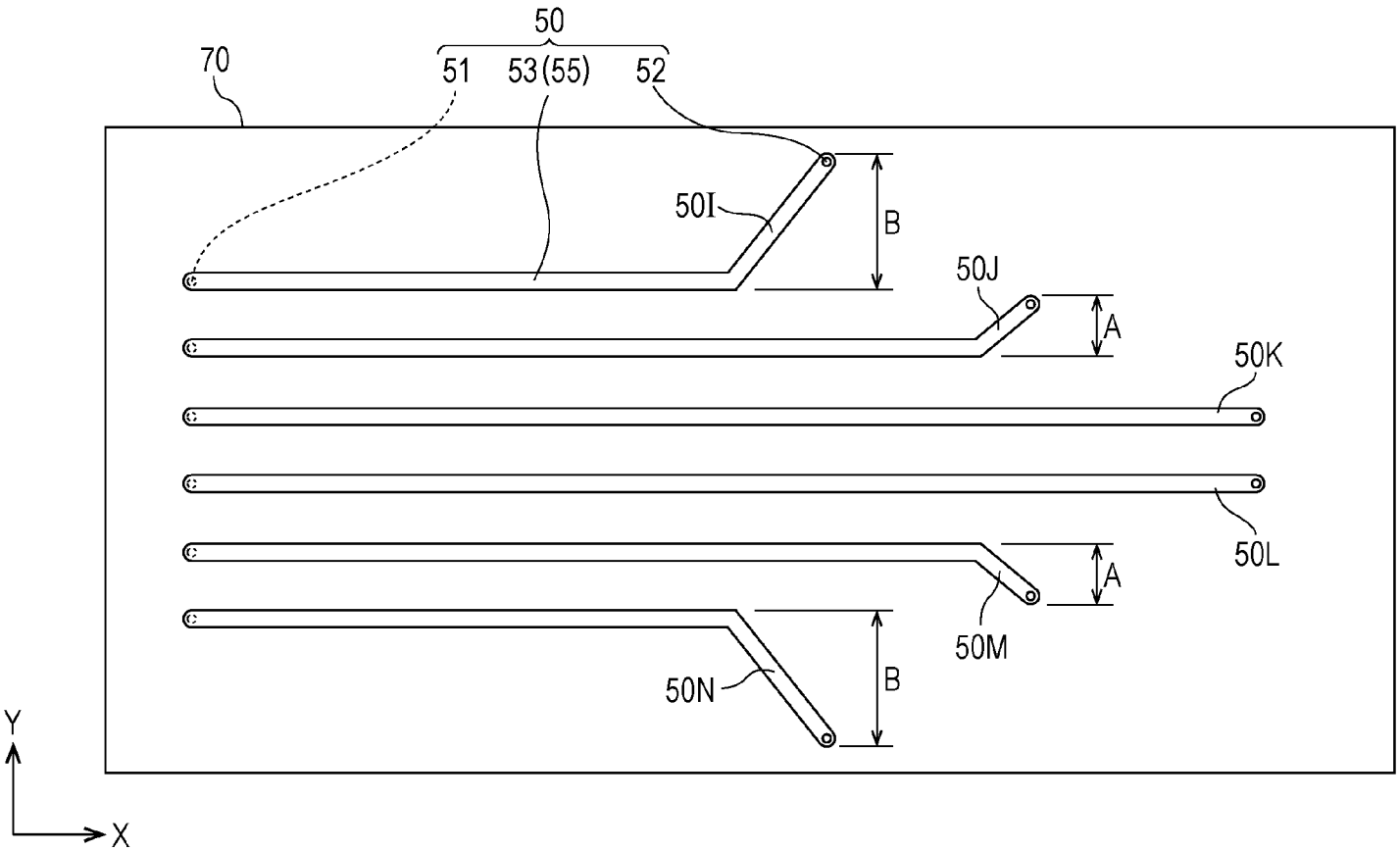
FIG. 9 is a top view illustrating the second member of a flow path member according to a second embodiment.

FIG. 9 is a top view illustrating the second member 70 of a flow path member 40 according to the embodiment. Meanwhile, the same reference numerals are used for the same components in the first embodiment, and the descriptions thereof are not repeated.

As shown in the drawing, six grooves 55 are formed in the second member 70, a first member 60 (not shown in the drawing) is joined to the second member 70, and thus six ink flow paths 50I to 50N are formed.

The horizontal flow path 53 of the ink flow paths 50K and 50L is the longest, and the horizontal flow paths 53 of the ink flow paths 50J and 50M are subsequently long, and the horizontal flow paths 53 of the ink flow paths 50I and 50N are the shortest.

The Y direction components of the horizontal flow paths 53 of the ink flow paths 50K and 50L are zero. The parallelisms of the horizontal flow paths 53 of the ink flow paths 50J and 50M are A, and the parallelisms of the ink flow paths 50I and 50N are B (A<B). Therefore, in this order, the discharge properties of bubbles along with the reciprocating motion of the head 1 is high, and, accordingly, bubbles stay easily in this order.

As described above, since the lengths of the ink flow paths 50K and 50L are long, the bubbles 80 stay easily but the Y direction components thereof are small. Therefore, the ink flow paths 50K and 50L have the high discharge properties of bubbles along with the reciprocating motion of the head 1.

In contrast, with respect to the ink flow paths 50I and 50N which have the horizontal flow paths 53 having large Y direction components, the discharge properties of the bubbles 80 along with the reciprocating motion of the head 1 is low. However, since the lengths of the respective ink flow paths 50I and 50N themselves are the shortest, the possibility that bubbles 80 remain is low.

Therefore, all the six horizontal flow paths 53 have a configuration in which bubbles are easily discharged.

According to the ink jet-type recording apparatus I according to the embodiment, in all the plurality of ink flow paths 50, the discharge properties of the bubbles along with the reciprocating motion of the head 1 in the X direction is improved.

Therefore, it is possible to effectively suppress all the ink flow paths 50 from being closed by bubbles, and ink is further securely supplied to the head main body 20, thereby providing the ink jet-type recording apparatus I in which reliability is improved.

Another Embodiment

Hereinbefore, although the embodiments according to the invention have been described, the basic configuration of the invention is not limited to the above-described embodiments.

The ink jet-type recording apparatus I according to the first to third embodiments does not have particular limitation to the kinds of liquid to be used.

For example, the plurality of ink flow paths 50 may be formed for the respective kinds of ink. This is useful for a case in which the easiness of the generation of bubbles differs according to the kinds of ink. In addition, in the plurality of ink flow paths 50, it is not necessary to circulate all of different kinds of ink. That is, the same kind of ink may be circulated through different ink flow paths 50.

Further, the storage element 3 which supplies pigment ink may be used as the liquid supply element. The pigment ink has properties in which bubbles are easily generated, compared to dye ink. However, since the ink jet-type recording apparatus I according to the invention has high discharge properties of bubbles even when the pigment ink is used, it is possible to prevent the ink flow paths from being closed by bubbles.

In addition, when CMYK ink (first liquid) which includes a relatively large amount of surfactant and white ink (second liquid) which includes (or does not include) a relatively small amount of surfactant are used, the white ink has larger surface tension, and thus bubbles are easily generated.

In such a case, it is preferable to cause an ink flow path, through which the white ink is circulated, to have the largest length and to cause the parallelism thereof to be the smallest. Therefore, it is possible to further securely suppress the staying and closing due to bubbles in the ink flow path, through which the white ink is circulated.

In addition, a pressure generation element which brings pressure change to the pressure generation chambers 235 is not limited to the unit described in the first embodiment. For example, it is possible to use a pressure generation unit which arranges a heater element in a liquid flow path and discharges ink droplets from nozzles according to bubbles generated due to the heat generation of the heater element, or to use a so-called electrostatic actuator which generates electrostatic force between a vibration plate and an electrode and discharges ink droplets from nozzles by transforming the vibration plate using the electrostatic force.

The ink jet-type recording apparatus I according to the first to third embodiments has a configuration in which ink is supplied to the head 1 from the storage element 3 which is provided in the apparatus main body 7 through the tube 4. That is a so-called off-carriage type. However, a configuration in which the storage element 3 is mounted on the carriage 2 together with the head 1, a so-called on-carriage type, may be used. In addition, the storage element 3 is not necessary to be provided in the apparatus main body 7, and may be provided on the outside of the apparatus main body 7 and may provide ink to the head 1 through a tube or the like.

Further, the invention has been widely intended for liquid ejecting apparatuses, and may be applied to an liquid ejecting apparatus which includes, for example, recording heads, such as various types of ink jet-type recording heads or the like, which are used for an image recording apparatus such as a printer or the like, a color material ejecting head which is used to manufacture a color filter of a liquid crystal display or the like, an electrode material ejecting head which is used to form an electrode of an organic EL display, an FED (electric field release display), or the like, a bioorganic substance ejecting head which is used to manufacture a biochip, or the like.

What is claimed is:

1. A liquid ejecting apparatus comprising:

a flow path member that includes a plurality of liquid flow paths through which liquid is circulated;

a liquid ejecting head that includes a head main body to which the liquid is supplied from the flow path member and which ejects the liquid to a recording medium; and a moving element that causes the liquid ejecting head to perform a main scan of the recording medium, wherein, when a main scanning direction is a first direction, a liquid ejection direction is a third direction, and a direction perpendicular to both the first direction and the third direction is a second direction, the plurality of liquid flow paths include substantially horizontal flow paths, and a longest one of the horizontal flow paths has a smallest dimension in the second direction from among the horizontal flow paths.

2. The liquid ejecting apparatus according to claim 1, wherein, a second direction dimension of each horizontal flow path is inversely proportional to a length of the horizontal flow path.

3. The liquid ejecting apparatus according to claim 1, wherein the horizontal flow paths are formed such that a plurality of linear partial flow paths are continuous, and wherein the longest horizontal flow path has a smallest summation of the second direction dimension for the respective partial flow paths from among the horizontal flow paths.

4. The liquid ejecting apparatus according to claim 1, wherein the horizontal flow paths are provided for respective kinds of the liquid.

5. The liquid ejecting apparatus according to claim 1, further comprising:

a liquid supply element that supplies pigment ink as the liquid.

6. The liquid ejecting apparatus according to claim 1, further comprising:

a liquid supply element that supplies the liquid, the liquid being a first liquid which includes a relatively large amount of surfactants and a second liquid which does not include the surfactant or includes a relatively small amount of surfactants, wherein the second liquid is supplied to the longest horizontal flow path which has the smallest dimension in the second direction from among the horizontal flow paths.

* * * * *